US006012692A

United States Patent [19]

Meck

[11] Patent Number: 6,012,692

[45] **Date of Patent: *Jan. 11, 2000**

[54] MOUNTING SYSTEM FOR FIXTURES

[75] Inventor: Leslie A. Meck, Blandon, Pa.

[73] Assignee: Baldwin Hardware Corporation, Reading, Pa.

[ * ] Notice: Under 35 U.S.C. 154(b), the term of this patent shall be extended for 313 days.

[21] Appl. No.: 08/827,841

[22] Filed: Apr. 11, 1997

Related U.S. Application Data

[63] Continuation of application No. 08/634,219, Apr. 18, 1996, abandoned, which is a continuation of application No. 08/321,377, Oct. 11, 1994, abandoned.

[51] Int. Cl.[7] ..... A47H 1/14

[52] U.S. Cl. ..... 248/251; 248/222.14; 248/262

[58] Field of Search ..... 248/251, 261, 248/262, 222.14, 222.11; 211/105.1, 105.2, 94

[56] References Cited

U.S. PATENT DOCUMENTS

| | | | |
|---|---|---|---|
| 1,055,925 | 3/1913 | Lathrop | 248/262 |
| 1,070,144 | 8/1913 | Lathrop | 248/262 |
| 1,165,046 | 12/1915 | Von Der Lin | 248/188.4 |
| 1,636,364 | 7/1927 | Hoegger | 248/222.1 |
| 1,773,586 | 8/1930 | Koering | 248/251 |
| 1,897,913 | 2/1933 | Pudliner . | |
| 1,962,739 | 6/1934 | Hoegger . | |
| 1,970,473 | 8/1934 | Parker | 248/222.1 |
| 1,989,329 | 1/1935 | McDonald | 248/222.1 |
| 2,035,568 | 3/1936 | Pudliner . | |
| 2,098,997 | 11/1937 | Bramming | 248/222.1 |
| 2,111,243 | 3/1938 | Hecht . | |
| 2,146,654 | 2/1939 | Shea et al. | 248/251 |
| 2,512,209 | 6/1950 | Marchand . | |
| 2,578,964 | 12/1951 | Bell | 248/251 |
| 2,968,460 | 1/1961 | Van Dusen | 248/205.3 |
| 4,610,517 | 9/1986 | Fukino et al. . | |
| 4,830,203 | 5/1989 | Ennis . | |
| 4,957,314 | 9/1990 | Basile et al. . | |
| 4,981,276 | 1/1991 | Agor et al. . | |

*Primary Examiner*—Ramon O. Ramirez
*Assistant Examiner*—Anita M. King
*Attorney, Agent, or Firm*—Myron B. Kapustij; Lloyd D. Doigan

[57] ABSTRACT

A mounting apparatus for attaching fixtures to a wall. The apparatus comprises a bracket comprised of a side wall and a front wall defining a socket with an open end, the bracket is secured to the wall by means of a mounting screw passing through the front wall. A shank portion of a fixture member is disposed in the socket after the bracket has been secured to the wall. The shank portion has an annular groove and is held in place in the socket by means of a set screw passing through the side wall and into the groove.

1 Claim, 1 Drawing Sheet

MOUNTING SYSTEM FOR FIXTURES

This application is a continuation of application Ser. No. 08/634,219 filed Apr. 18, 1996, now abandoned, which is a continuation of application Ser. No. 08/321,377 filed on Oct. 11, 1994, now abandoned.

FIELD OF THE INVENTION

The present invention relates to a bracket system for securing fixtures of various kinds, particularly bathroom fixtures to a wall or similar supporting surface.

BACKGROUND OF THE INVENTION

In securing fixtures such as bathroom fixtures to a wall it is desirable for aesthetic purposes to effect the connection between the fixture and the wall by means that are visually undetectable. It is further desirable to insure that such connection is secure and to accomplish such connection in a simple and expedient manner. The present invention provides such a mounting system.

SUMMARY OF THE INVENTION

The instant invention is directed to a mounting system for attaching fixtures, particularly bathroom fixtures such as towel racks, cup holders, and the like to walls. The mounting system includes a mounting bracket having a side wall and a front wall defining a socket. The mounting bracket has an open rear in communication with the socket. The front wall is adapted to be in contact with a wall and is attached thereto by a mounting screw extending through an aperture in the front wall. The socket is adapted to receive a shank of a fixture member. The shank has a V-shaped groove extending around its entire circumference. A set screw, extending through a hole in the side wall of the bracket, engages the front face of the V-shaped groove thereby pulling the shank into the socket and securing it in place.

DESCRIPTION OF THE PREFERRED EMBODIMENT

Figure 1:
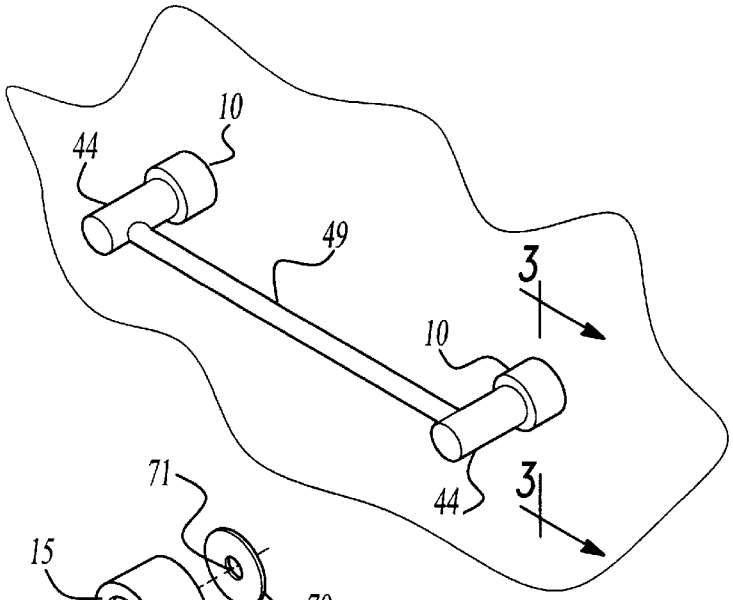
FIG. 1 is a perspective view of a towel rack mounted to a wall.

The instant invention is directed to a bracket for securing fixtures, such as bathroom fixtures, to a wall or other supporting surface. As illustrated in the drawings the bracket is comprised of a decorative collar 10 having a side wall 18 and a front wall 17. Front wall 17 has an aperture 19 extending therethrough adapted to receive mounting screw 60 which holds collar 10 to a wall 50. Aperture 19 is preferably frustoconical in shape so that screw head 61 is retained within wall 17 and is preferably flush with the interior surface of wall 17. Aperture 19 is in communication with socket 11 defined by side wall 18 and front wall 17. Socket 11 has an open end 16 Side wall 18 has side opening 14 extending therethrough. Side opening 14 is internally threaded and is adapted to threadedly receive externally threaded set screw 30. Opening 14 is perpendicular to wall 18 and to the longitudinal axis of collar 10.

Figure 3:
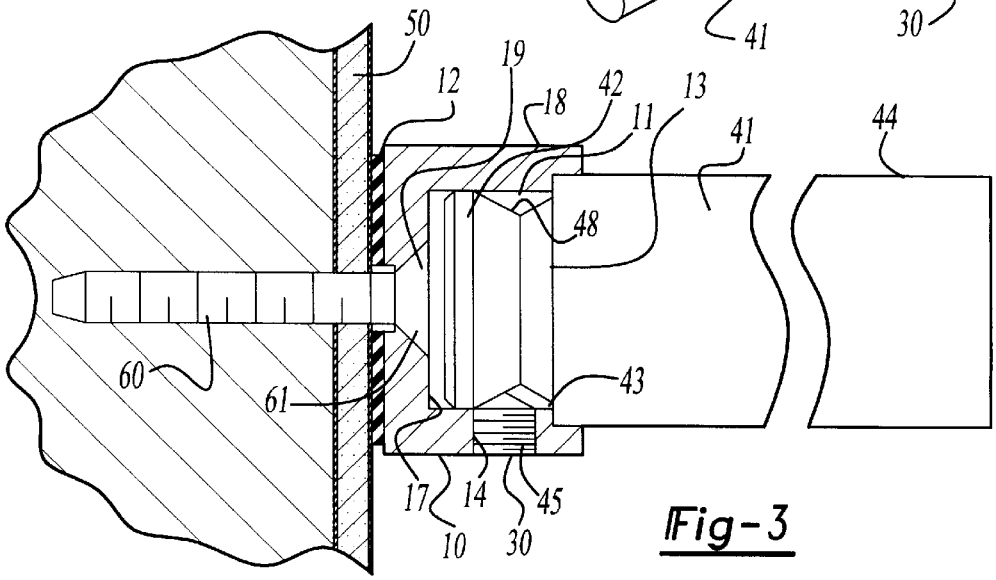
FIG. 3 is a sectional view taken along lines 3—3 of FIG. 1.

The socket 11 is adapted to receive a shank portion 42 of outer fixture member 44. Outer fixture member 44 consists of body portion 41 and shank portion 42. Preferably the cross-sectional shape of shank 42 is complementary to the cross-sectional shape of socket 11. In the embodiment illustrated in the drawings both the shank portion 42 and the body portion 41 have a circular cross-section. As best illustrated in FIG. 3 the outer diameter of body portion 41 is larger than the outer diameter of shank portion 42 thereby forming shoulder 45 between body portion 41 and shank portion 42. Shank portion 42 has an annular V-shaped groove 43 extending therearound.

As illustrated in FIG. 3 with the shank portion 42 disposed in socket 11 set screw 30 is disposed in groove 43. More particularly set screw 30 abuts against the forward edge of groove 43 thus pulling shank 42 into socket 11 (to the left in FIG. 3) and keeping the shank 42 disposed in socket 11 with the shoulder 45 seated on top surface 15 of wall 18.

An anti-rotation pad 70 is provided intermediate the wall 50 and the front face 12 of wall 17 of collar 10. The anti-rotation pad 70 has a central aperture 71 to allow passage of screw 60 therethrough. The pad 70 can be comprised of rubber or other similar non-slippery material and keeps collar 10 from rotating while it is being attached to wall 50 and after said attachment.

In assembling the mounting bracket of the instant invention the front face 12 of front wall 17 of collar 10 is placed against wall 50 with anti-rotation pad 70 interposed between wall 50 and the front face 12 of front wall 17. Fastening screw 60 is passed through the socket 11, opening 19 in wall 17, opening 71 in pad 70, and screwed into the wall 50, thus drawing the collar 10 firmly into contact with the wall. The shank portion 42 of fixture member 44 is then inserted into socket 11, the fixture member 44 serving to conceal the screw 60 by which the collar 10 is secured to the wall 50. Once the shank portion 42 is disposed in socket 11 set screw 11 is screwed into opening 14. As set screw 14 is screwed into and advances in opening 14 its tip extends into groove 43 and abuts against forward edge 48 of groove 43 thus further pulling shank portion 42 into socket 11 (to the left in FIG. 3) until further movement is prevented by shoulder 45 abutting top surface 15 of wall 18. The set screw 30 serves to firmly secure the fixture to the collar. Even if the set screw is not fully tightened the shank portion 42 will not fall out of the socket 11 because the tip of set screw 14 will still be in contact with the forward edge 48 of groove 43 thus keeping the shank portion within socket 11.

Figure 2:
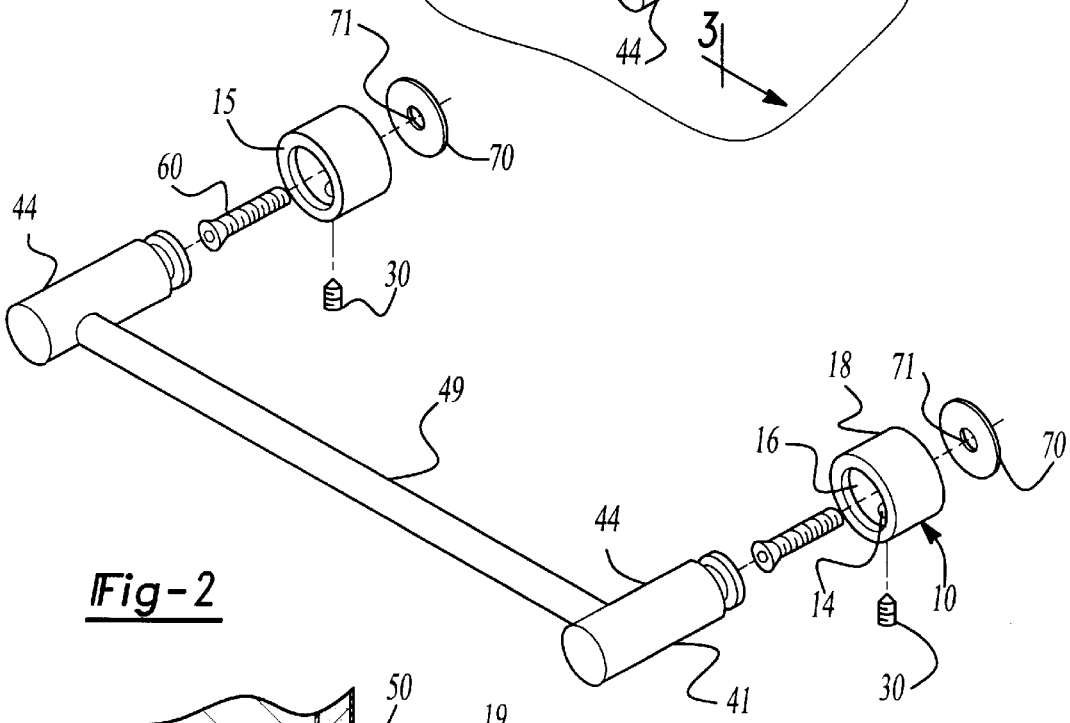
FIG. 2 is an exploded perspective view of the towel rack illustrated in FIG. 1.

In the embodiment illustrated in FIGS. 1 and 2 the fixture is a towel rack comprising two fixture members 44 which are adapted to engage collars 10 and a cross bar 49 connecting the two fixture members 44 upon which towels are hung.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A wall fixture consisting essentially of: a separate bracket portion adapted for mounting on a room wall, and a fixture portion comprising a body section and a shank section, the bracket portion comprising at least one side wall, a front wall adapted to lie adjacent said room wall, a socket defined by said at least one side wall and said front wall, said socket having an open end opposite said front wall, a generally smooth, circular cross-sectional shape, and being adapted to receive said shank section of said fixture portion therein, a single set screw receiving hole extending perpendicularly through said side wall, a single mounting screw hold extending through said front wall, and a single room wall mounting screw extending through said hole extending through said front wall and directly engaging said room wall thereby securing said bracket portion to said room wall, a single set screw having a substantially taped end extending through said set screw receiving hole, the shank section of said fixture portion having a single V-shaped groove extending circumferentially there around adapted to receive said substantially tapered end of the set screw thereby securing said shank section in said socket, said shank section having a circular cross-sectional shape which is complementary to the cross-sectional shape of said socket and an anti-rotation pad between the room wall and the front wall of said bracket portion.

* * * * *